US005250923A

United States Patent [19]

Ushiro et al.

[11] Patent Number: 5,250,923

[45] Date of Patent: Oct. 5, 1993

[54] LAMINATED CHIP COMMON MODE CHOKE COIL

[75] Inventors: Tomoaki Ushiro; Toshio Kawabata; Daiji Kono; Hisato Oshima, all of Nagaokakyo, Japan

[73] Assignee: Murata Manufacturing Co., Ltd., Kyoto, Japan

[21] Appl. No.: 997,393

[22] Filed: Dec. 28, 1992

[30] Foreign Application Priority Data

Jan. 10, 1992 [JP] Japan ..... 4-021774

[51] Int. Cl.[5] ..... H01F 27/30

[52] U.S. Cl. ..... 336/83; 336/200; 336/219; 336/220; 336/234

[58] Field of Search ..... 336/83, 200, 232, 219, 336/234, 192, 183, 225, 220, 606, 609

[56] References Cited

U.S. PATENT DOCUMENTS 3,765,082 10/1973 Zyetz ..... 336/200

4,959,631 9/1990 Hasegawa et al. ..... 336/83

*Primary Examiner*—Thomas J. Kozma

*Attorney, Agent, or Firm*—Jordan and Hamburg

[57] ABSTRACT

A conductor pattern for forming coils and lead-out electrodes which are led out from the coils are formed on a magnetic substance sheet. Furthermore, said magnetic substance sheet is provided with through-holes for connecting the conductor patterns. The magnetic substance sheets disposed respectively just over and just under the conductor pattern that becomes the lead-out electrodes are coated with non-magnetic material paste. A laminated chip common mode choke coil is produced by laminating these magnetic substance sheets and baking them integrally and thereafter forming external electrodes. The non-magnetic material diffuses into the magnetic substance sheet by baking the lamination of the magnetic substance sheets, and the permeability of that portion becomes low. Therefore, the magnetic reluctance around the lead-out electrode becomes high, thus reducing leakage flux around that portion. Thereby, coupling between two coils formed in the choke coil becomes good.

5 Claims, 6 Drawing Sheets

LAMINATED CHIP COMMON MODE CHOKE COIL

BACKGROUND OF THE INVENTION

1. Field of the Invention

This invention relates to a laminated chip common mode choke coil and, more particularly, to the same which is used for a high frequency circuit.

FIG. 6 is an exploded perspective view showing processes of manufacturing a conventional laminated chip common mode choke coil. In this conventional example, the laminated chip common mode choke coil having a winding of 2.5 turns is formed by laminating magnetic substance sheets 31*a*–31*n* provided with a conductor pattern and by pressing and thereafter baking them into an integral entity. Ferrite sheets 31*b*, 31*d*–31*k* and 31*m* are provided with a conductor pattern and a through-holes. The number of turns of this laminated chip common mode choke coil can be increased by repeatedly laminating ferrite sheets 31*f*–31*i* for example.

On ferrite sheets 31*a* and 31*n*, no conductor pattern is formed. On the surface of the ferrite sheet 31*b*, a conductor pattern 32 is formed which becomes a lead-out electrode at one end of one coil. One end of the conductor pattern 32 is drawn out to the outer edge of the ferrite sheet 31*b*, and the other end extends to a through-hole 32*a*. Following the ferrite sheet 31*b*, a ferrite sheet 31*c* provided with a through-hole 33*a* is laminated.

A conductor pattern 34 which becomes one end of the other coil is formed, roughly in a U shape, on the ferrite sheet 31*d*. One end of the conductor pattern 34 is led out to the outer edge of the ferrite sheet 31*d* to be formed into a conductor pattern 34*a* that becomes a lead-out electrode, and the other end extends to a through-hole 34*b*. Furthermore, on the ferrite sheet 31*d*, a through-hole 34*c* which connects to the through-hole 33*a* is formed in a position not contacting with the conductor pattern 34.

On the ferrite sheets 31*e*, 31*f*, 31*g*, 31*h*, 31*i* and 31*k*, conductor patterns 35, 36, 37, 38, 39 and 41 are formed respectively, and through-holes 35*a*, 35*b*, 36*a*, 36*b*, 37*a*, 37*b*, 38*a*, 38*b*, 39*a*, 39*b* and 41*a* are also formed in the above ferrite sheets.

On a ferrite sheet 31*j*, a conductor pattern 40 which becomes the other end of the other coil is formed roughly in an L shape. On end of the conductor pattern 40 is led out to the outer edge of the ferrite sheet 31*j* to be formed into a conductor pattern 40*a* that becomes a lead-out electrode. On the ferrite sheet 31*j*, a through-hole 40*b* which connects to the through-hole 39*a* is formed in a position not contacting with the conductor pattern 40.

A conductor pattern 43 is formed which extends to the outer edge of the ferrite sheet 31*m* and becomes the lead-out electrode of the other end of one coil.

In the choke coil, one coil comprises the conductor patterns 35, 37, 39 and 41, and both ends of it are connected to the conductor patterns 32 and 34 respectively. And the other coil comprises the conductor patterns 34, 36, 38 and 40, and both ends Of it are connected to the conductor patterns 34*a* and 40*a* respectively.

As shown in FIG. 7, in the choke coil, a rectangular coil of 1.0 turn is formed with the ferrite sheets 31*f*, 31*g*, 31*h* and 31*i*. As shown in FIGS. 8 or 9, a hexagonal coil

45 or a circular coil 46 each having a different pattern from the rectangle may be formed.

In a common mode choke coil, normal mode impedance may lead to attenuation of a signal, and thus it is desirable to suppress the impedance to a low level. However, among conventional chip type common mode coils such as the above-mentioned, a good common mode impedance characteristic and a good resistance characteristic could be obtained, while a normal mode impedance characteristic at a high frequency (30–150 MHz) is not good. As shown in FIG. 5, a choke coil having the coil pattern of FIG. 7 causes an impedance of 110Ω at a frequency in the vicinity of 50 MHz.

A choke coil having another coil pattern such as shown in FIGS. 8 or 9 similarly has a problem of increase in normal mode impedance although it satisfies other characteristics. It was found that a portion not contributing to coupling between the two coils exists in the lead-out electrode as the cause of increase in normal mode impedance.

SUMMARY OF THE INVENTION

Therefore, the principal object of the present invention is to provide a laminated chip common mode choke coil which is able to improve the coupling between the two coils and to reduce a peak value of the normal mode impedance.

The present invention is a laminated chip common mode choke coil wherein a pair of coils and lead-out electrodes led out from the coils are formed by laminating a plurality of magnetic substance sheets provided with a conductor patterns and through-holes for connecting the conductor patterns, and wherein the permeability around the lead-out electrode is reduced by applying non-magnetic material to the magnetic substance sheets around the conductor patterns that become the lead-out electrodes and by diffusing the non-magnetic material.

Because of the low permeability around the lead-out electrode, the magnetic reluctance of that portion becomes high, and thus magnetic flux scarcely generates in the circumference of the lead-out electrode. Therefore, leakage flux in the portion of the lead-out electrode is little.

According to the present invention, the leakage flux in the portion of the lead-out electrode becomes little, and the coupling between the two coils becomes good. Therefore, the normal mode impedance can be reduced and the attenuation of a signal can be decreased.

The above and other objects, features, aspects and advantages of the invention will more fully be apparent from the detailed description of the following embodiments with reference to the accompanying drawings.

DESCRIPTION OF THE PREFERRED EMBODIMENTS

Figure 1:
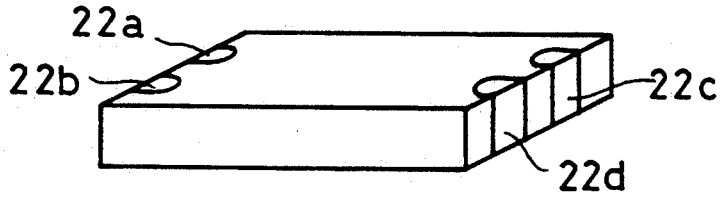
FIG. 1 is a perspective view showing one embodiment of the invention.
Figure 2:
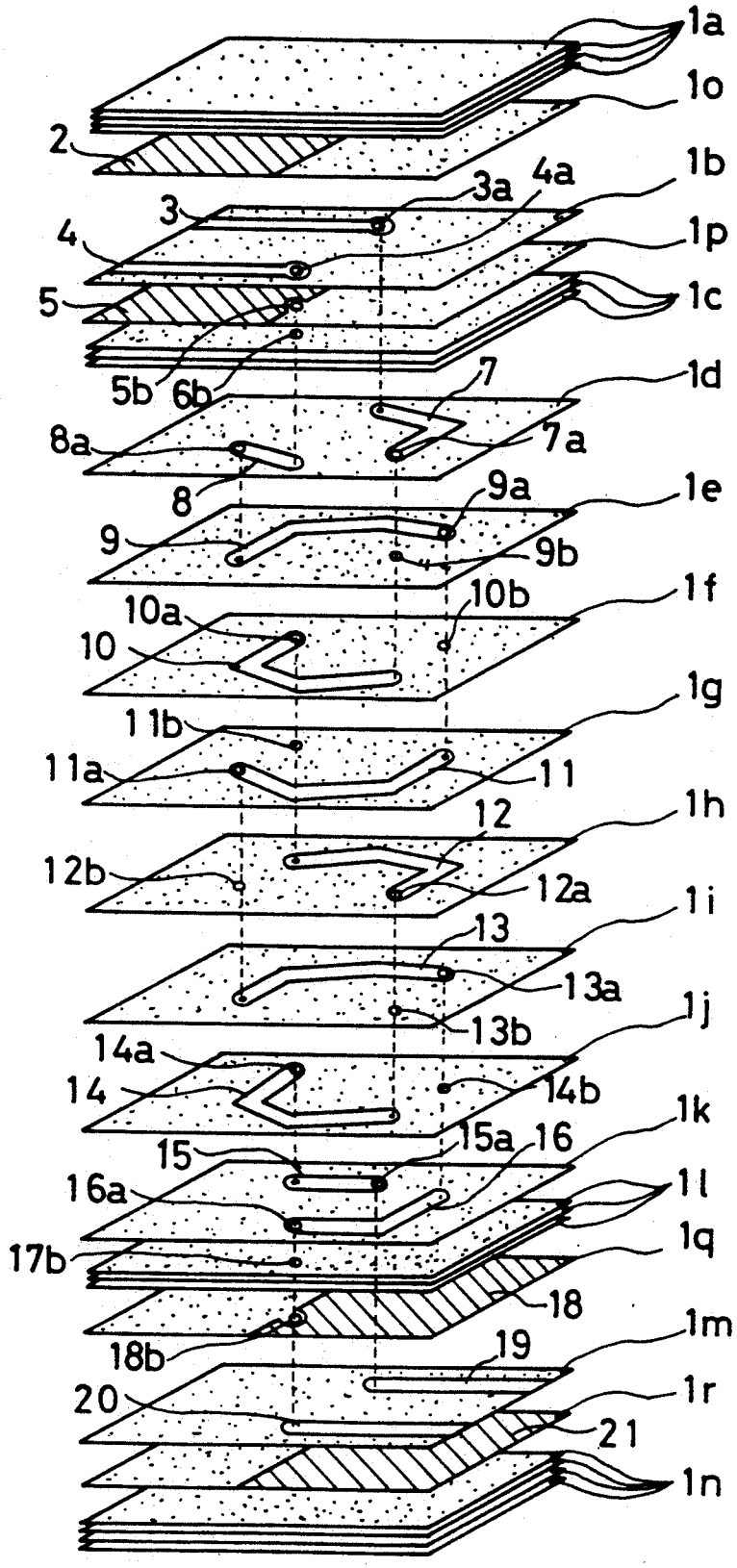
FIG. 2 is an exploded perspective view showing processes of manufacturing the laminated chip common mode choke coil of FIG. 1.

FIG. 1 is a perspective view showing one example of the laminated chip common mode choke coil of the invention, and FIG. 2 is an exploded perspective view showing its manufacturing processes.

Figure 8:
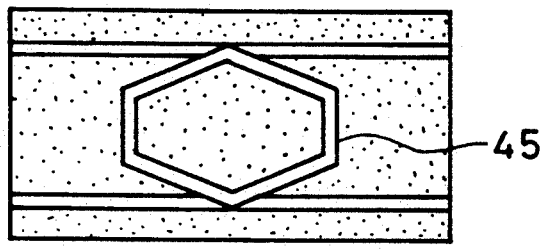
FIG. 8 PRIOR ART
FIG. 8 is an illustration showing another example of a coil pattern of the conventional laminated chip common mode choke coil.

As shown in FIG. 2, a laminated chip common mode choke coil is formed in such a manner that ferrite sheets 1*b*, 1*d*, 1*e*, 1*f*, 1*g*, 1*h*, 1*i*, 1*j*, 1*k* and 1*m* each provided with a conductor pattern, and ferrite sheets 1*a*, 1*o*, 1*p*, 1*c*, 1*l*, 1*q*, 1*r* and 1*n* each provided with no conductor pattern are laminated and pressed one another and thereafter baked into an integral entity. In the choke coil, as shown in FIG. 8, a hexagonal coil pattern is formed. In addition, a number of turns of the coil can be increased by repeatedly laminating given magnetic substance sheets.

On the ferrite sheets 1*a* and 1*n*, nothing is formed. On the surface of the ferrite sheet 1*b*, conductor patterns 3 and 4 for lead-out electrodes at one end of two coils are formed in parallel. First ends of these conductor patterns 3 and 4 are led out to separate positions on the same side of the ferrite sheet 1*b*. The other ends of the conductor patterns 3 and 4 are extended to through-holes 3*a* and 4*a* formed in the ferrite sheet 1*b*.

Figure 3:
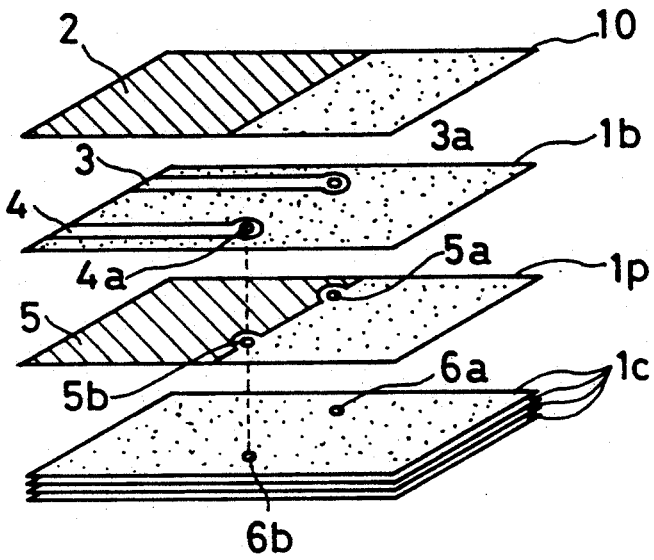
FIG. 3 is a perspective view showing part of the lamination structure of FIG. 2.

Between the ferrite sheet 1*a* and the ferrite sheet 1*b*, a sheet 1*o* coated with non-magnetic material is disposed. As shown in FIG. 3, the sheet 1*o* is a ferrite sheet which the non-magnetic material paste is coated on a portion 2 opposing to the conductor patterns 3 and 4 on the surface of the ferrite sheet 1*b*.

Following the ferrite sheet 1*b*, a sheet 1*p* coated with non-magnetic material is laminated. The sheet 1*p* is a ferrite sheet which the non-magnetic material paste is coated on a portion 5 opposing to the conductor patterns 3 and 4 on the surface of the ferrite sheet 1*b*. In addition, the sheet 1*p* coated with non-magnetic material is provided with through-holes 5*a* and 5*b*. And the ferrite sheet 1*c* is provided with through-holes 6*a* and 6*b* at the positions corresponding to the through-holes 5*a* and 5*b* respectively.

Following the ferrite sheet 1*c*, the ferrite sheet 1*d* is laminated. On the ferrite sheet 1*d*, conductor patterns 7 and 8 which become one end of the two coils are formed. First ends of the conductor patterns 7 and 8 are connected to the through-holes 3*a* and 4*a* of the conductor patterns 3 and 4 respectively and the other ends are provided with through-holes 7*a* and 8*a*.

Furthermore, following the ferrite sheet 1*d*, the ferrite sheet le is laminated. On the ferrite sheet 1*e*, a conductor pattern 9 is formed which comprises three sides of a hexagon. One end of the conductor pattern 9 is connected to the through-hole 8*a* of the conductor pattern 8, and the other end is provided with a through-hole 9*a*. Furthermore, in the ferrite sheet 1*e*, a through-hole 9*b* is formed at the position corresponding to the through-hole 7*a* of the conductor pattern 7.

Following the ferrite sheet 1*e*, the ferrite sheet 1*f* is laminated. On the ferrite sheet 1*f*, a conductor pattern 10 is formed which comprises three sides of a hexagon forming the other coil. One end of the conductor pattern 10 is connected to the through-hole 7*a* of the conductor pattern 7, and the other end is provided with a through-hole 10*a*. Furthermore, in the ferrite sheet 1*f*, a through-hole 10*b* is formed at the position corresponding to the through-hole 9*a* of the conductor pattern 9.

Similarly, on the ferrite sheets 1*g*, 1*h*, 1*i* and 1*j*, conductor patterns 11, 12, 13 and 14 are formed and through-holes 11*a*, 11*b*, 12*a*, 12*b*, 13*a*, 13*b*, 14*a* and 14*b* are formed in the above ferrite sheets respectively.

On the ferrite sheet 1*k*, conductor patterns 15 and 16 which become the other ends of the two coils are so formed that they become sides of the respective hexagons. One end of the conductor pattern 15 is connected to the through-hole 14*a* of the conductor pattern 14, and one end of the conductor pattern 16 is connected to the through-hole 13*a* of the conductor pattern 13. Furthermore, the other end of the conductor pattern 15 is provided with a through-hole 15*a*, and the other end of the conductor pattern 16 is provided with a through-hole 16*a*.

Figure 4:
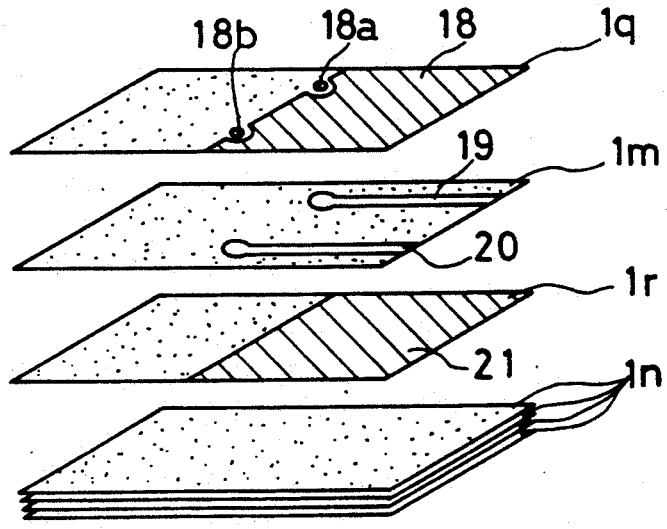
FIG. 4 is a perspective view showing another part of the lamination structure of FIG. 2.

In the ferrite sheet 11, through-holes 17*a* and 17*b* are formed at the positions corresponding to the through-holes 15*a* and 16*a*. Furthermore, on the ferrite sheet 1*m*, conductor patterns 19 and 20 which become lead-out electrodes are formed in parallel. Between the ferrite sheets 1*l* and 1*m*, a sheet 1*q* coated with non-magnetic material is laminated. As shown in FIG. 4, the sheet 1*q* coated with non-magnetic material is a ferrite sheet which the non-magnetic material paste is coated on the portion 18 opposing to the conductor patterns 19 and 20 on the surface of the ferrite sheet 1*m*.

Following the ferrite sheet 1*m*, the ferrite sheet 1*r* is laminated. The sheet 1*r* is a ferrite sheet which the nonmagnetic material paste is coated on the portion 21 opposing to the conductor patterns 19 and 20 on the surface of the ferrite sheet 1*m*. Following this ferrite sheet 1*r*, the ferrite sheet 1*n* is laminated.

The laminated chip common mode choke coil is formed by laminating and integrally baking the ferrite sheets 1*a*–1*n* and by making external electrodes 22*a*, 22*b*, 22*c* and 22*d*. In this choke coil, one coil comprises the conductor patterns 7, 10, 12, 14 and 15, while the other coil comprises the conductor patterns 8, 9, 11, 13 and 16. Both ends of one coil are connected to the lead-out electrodes 3 and 19 respectively, and both ends of the other coil are connected to the lead-out electrodes 4 and 20 respectively. In this choke coil, the two coils having a hexagonal shape and a 1.0 turn are formed with the ferrite sheets 1*g*1*j*.

Furthermore, the external electrodes 22*a*, 22*b*, 22*c* and 22*d* are respectively connected to the lead-out electrodes formed with the conductor patterns 3, 4, 19 and 20.

In order to obtain connections between the electrodes, it is necessary that the through-holes formed in the ferrite sheets are coated with Ag paste or Ag - Pd paste. This is the same as to the ferrite sheets 1*p* and 1*q*, however no through-hole is necessary for the ferrite sheets 1*o* and 1*r*.

Figure 5:
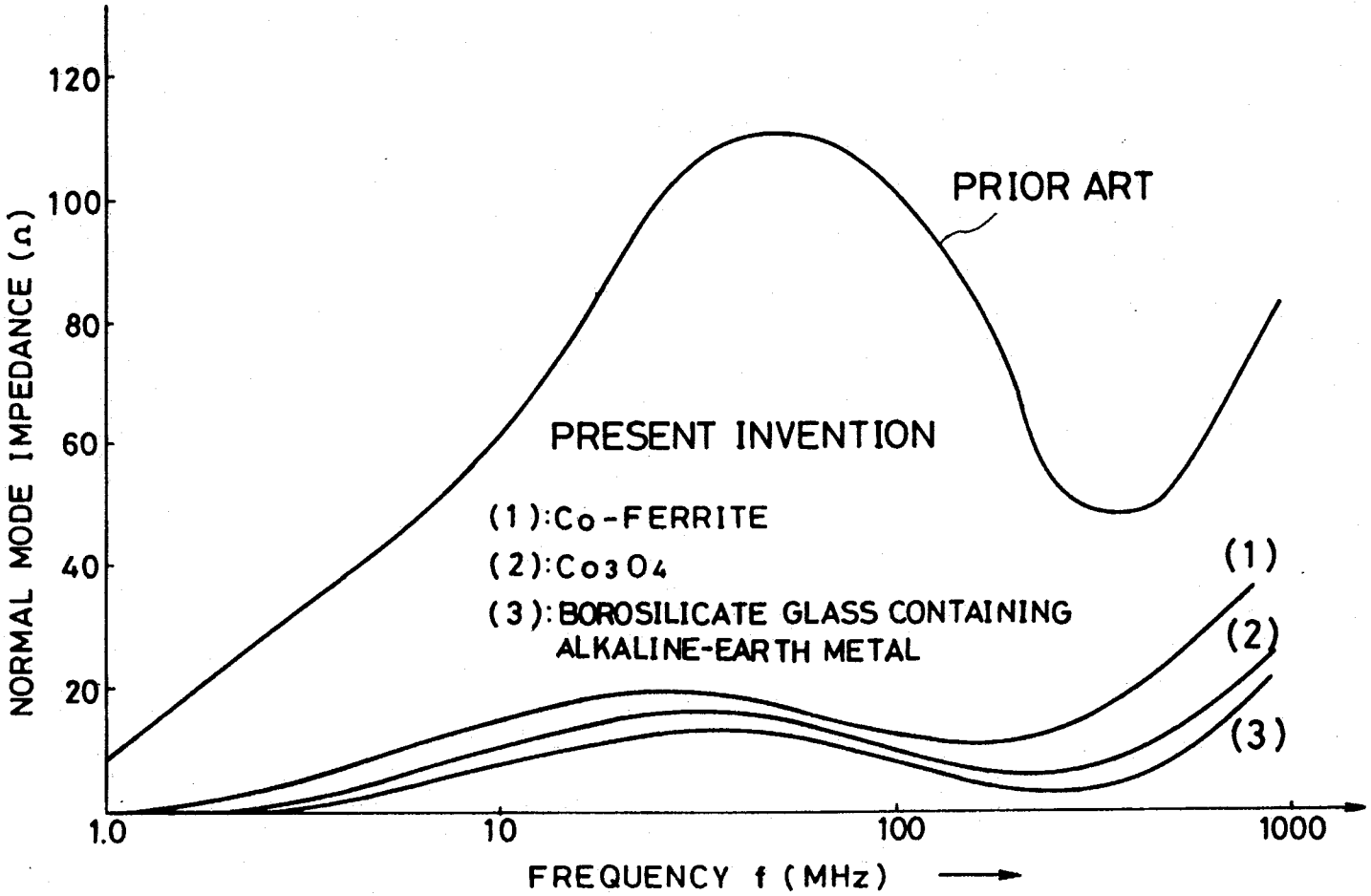
FIG. 5 is a graph showing frequency characteristics of normal mode impedances of the choke coils of the invention and a conventional choke coil.
Figure 6:
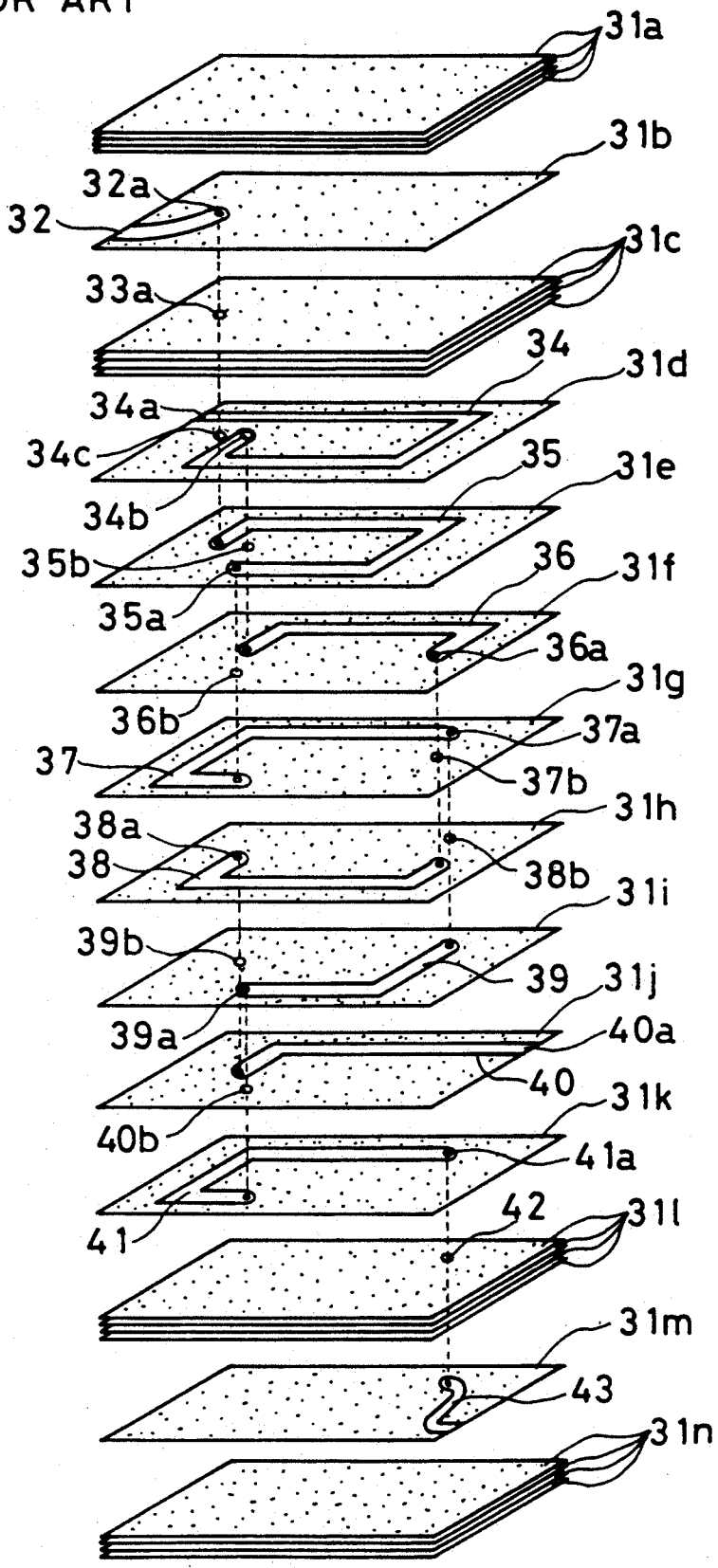
FIG. 6 PRIOR ART
FIG. 6 is an exploded perspective view showing processes of manufacturing a conventional laminated chip common mode choke coil.

As for the material of the ferrite sheets, Ni-Cu-Zn ferrite or the like is used for example. Furthermore, as to the material of the non-magnetic material paste, anything which diffuses into the ferrite sheet and reduces its permeability may be used. However, some of the non-magnetic materials may cause cracks of a coating surface of the non-magnetic material paste, and thus it is necessary to check a particle size of the material powder and an amount of varnish before preparing the paste. In this experiment, the choke coils were formed using three kinds of non-magnetic material paste, that is, (1) Co-ferrite, (2) $Co_3O_4$, and (3) Borosilicate glass containing alkaline-earth metal, and the characteristics of the choke coils were measured, and the data is shown in FIG. 5. The three kinds of the paste had a 20 μm in thickness before sintering. The Ni-Cu-Zn ferrite having a permeability of 600 was used.

In a choke coil of the invention, the non-magnetic material diffuses and the permeability around the lead-out electrode becomes low by baking the ferrite lamination. Therefore, the magnetic reluctance of that portion becomes high, thus making it hard to generate magnetic flux. Thereby, leakage flux generated in the portion of the lead-out electrode becomes little, and thus coupling between the two coils becomes good. Thus, as shown in FIG. 5, the peak value of a normal mode impedance could be reduced to less than 20Ω.

Figure 7:
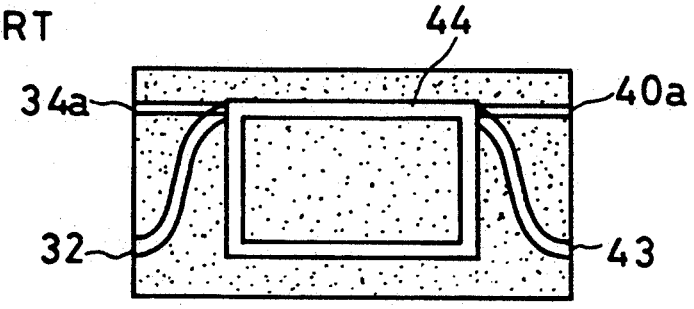
FIG. 7 PRIOR ART
FIG. 7 is an illustration showing a coil pattern of the conventional laminated chip common mode choke coil.
Figure 9:
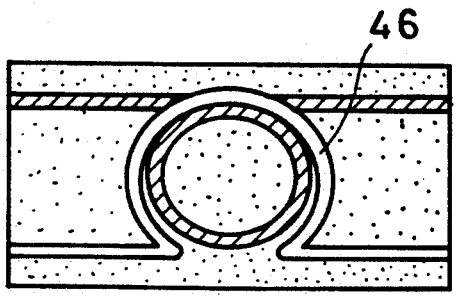
FIG. 9 PRIOR ART
FIG. 9 is an illustration showing still another example of a coil pattern of the conventional laminated chip common mode choke coil.

In addition, if a number of the ferrite sheets coated with the non-magnetic material paste is increased, an effect of reducing the normal mode impedance can be further enhanced. The non-magnetic material paste may be coated on both sides of the ferrite sheet. Furthermore, a choke coil having a desired number of turns can be obtained by adjusting a number of the ferrite sheets provided with a conductor pattern. The coil pattern to be formed can be made in the shape of FIGS. 7 or 9 other than a hexagon.

It will be apparent from the foregoing that, while the present invention has been described in detail and illustrated, these are only particular illustrations and examples and the invention is not limited to these. The spirit and scope Of the invention is limited only by appended claims.

What is claimed is:

1. A laminated chip common mode choke coil wherein a pair of coils and lead-out electrodes led out from said coils are formed by laminating a plurality of magnetic substance sheets provided with conductor patterns and through-holes for connecting said conductor patterns and wherein permeability around said lead-out electrodes is reduced by applying non-magnetic material to said magnetic substance sheets around the conductor patterns that become said lead-out electrodes and by diffusing the non-magnetic material.

2. A laminated chip common mode choke coil according to claim 1, wherein said magnetic substance sheets are made of Ni-Cu-Zn ferrite.

3. A laminated chip common mode choke coil according to claim 2, wherein said non-magnetic material is Co-ferrite.

4. A laminated chip common mode choke coil according to claim 2, wherein said non-magnetic material is $Co_3O_4$.

5. A laminated chip common mode choke coil according to claim 2, wherein said non-magnetic material is borosilicate glass containing alkaline-earth metal.

* * * * *